United States Patent [19]

Connors

[11] Patent Number: 4,498,252

[45] Date of Patent: Feb. 12, 1985

[54] FOOTWEAR PROTECTOR

[76] Inventor: Paul E. Connors, 2275 Grand Ave., San Diego, Calif. 92109

[21] Appl. No.: 431,155

[22] Filed: Sep. 30, 1982

[51] Int. Cl.[3] ..... A43B 13/22

[52] U.S. Cl. ..... 36/72 B; 36/72 R

[58] Field of Search ..... 36/72 B, 68, 69, 72 R; D2/277

[56] References Cited

U.S. PATENT DOCUMENTS

| | | | |
|---|---|---|---|
| 630,726 | 8/1899 | Morrow | 36/72 B |
| 1,571,466 | 2/1926 | Barthes | 36/72 B |
| 1,816,784 | 7/1931 | McDermott | D2/277 |
| 3,851,412 | 12/1974 | Voegele et al. | 36/72 B |

FOREIGN PATENT DOCUMENTS

| | | | |
|---|---|---|---|
| 717083 | 10/1966 | Italy | 36/72 B |

*Primary Examiner*—Werner H. Schroeder
*Assistant Examiner*—Steven N. Meyers
*Attorney, Agent, or Firm*—Thomas J. Tighe

[57] ABSTRACT

A footwear protector with a shield portion which is a generally U-shaped wall with an open front adapted to follow the general contour of the heel and a suitable portion of the backside of the footwear. The first heel binding strap portion projects outwardly from the lateral edges of the shield portion forming a loop at the base of the shield which loop resiliently fastens around about the heel and embraces the heel breast. A heel stop portion at the base of the shield locates the heel and prevents the shield from riding up the heel. A second heel binding strap portion extends across the saddle of the shield and performs the same function as the first binding strap for heels too small to be bound by the first strap. Extending inward from the back of the shield and spaced above the base of the heel is a tab means. The tab means performs the function of a binding strap for heels with significantly reduced cross section such as spiked and high heels. The protector is a single molded piece of elastic material which can be modified by its user to conform to the heel's size of the target of the footwear. It is modified by the use of common household shears.

5 Claims, 7 Drawing Figures

FOOTWEAR PROTECTOR

BACKGROUND OF THE INVENTION

This invention relates to devices for the protection of shoes from skuffing and, in particular, to heel protectors.

The problem addressed by this invention is the skuffing, marring, scratching and general disfiguration of the heels and back portions of shoes, particularly the right shoe, caused by abrasive contact with the floor of a vehicle. In the United States, the right shoe is marred much more than the left because of the fact that the right foot is used to operate the accelerator pedal of the vehicle. In operating the accelerator pedal, the right heel is typically resting on the floor carpet or floor mat. The resting point forms a fulcrum about which the foot is rotated during the operation of the accelerator pedal. If the foot is maintained in a vertical position then only the very base of the heel becomes marred, but most drivers have a tendency to rotate their foot slightly to the right which is more of a relaxed position for the foot and leg. As the foot rotates to the right, the fulcrum point shifts with the result that the heel ends up slightly to the left of the pedal and the fulcrum point becomes the top of the heel. As the pedal is operated the entire heel and a portion of the shoe is in contact with the floor. If the floor was carpeted and completely clean, there would be no problem, but most automobile carpets somehow acquire dust and dirt and sand which all act as an abrasive and which skuff and otherwise mar the heel and shoe. It is, therefore, highly desirable to provide a device which protects the aforesaid portion of a driver's shoes or boots and which is easily applied onto the heel and easily removed.

This invention presents a device with the desired characteristics of complete protection for the heel and shoe, ease of application onto the shoe, boot or heel, and easy removal.

Other heel protective devices have been presented in the past. U.S. Pat. No. 1,571,466 by E. Barthes presents a heel protector which is held in place by a U-shaped leaf spring. U.S. Pat. No. 3,095,659 by A McClellam presents a shoe protector which is also held in place by a U-shaped spring. U.S. Pat. No. 3,851,412 by Vogele et al. presents a heel protector cover which is also held in place by a U-shaped spring. Two (2) variations are presented, a protector for a man's shoe and a protector for a woman's high heels. U.S. Pat. No. Re. 19,543 by N. F. Winget presents a guard for shoe heels which also uses a U-shaped spring to hold the guard in place. U.S. Pat. No. Des. 192,208 presents a shoe heel protector which appears to have three (3) shaped spring ribs which hold the device in place. United Kingdom Pat. No. 384,210 by Gierach presents a protective cap for footwear which is held in place on a shoe by the hands of a steel bow which are inwardly bent and bear against the heel breast. A Republic of Germany Pat. No. 458,992 and a French Pat. No. 640,150 both present heel protectors which are held in place by U-shaped springs or metallic bow-shaped inserts. All of the patents mentioned in this paragraph have similar drawbacks. They all involve the use of some metallic spring either a U-shaped spring or a bow spring. Furthermore, the heel protectors were contoured to closely match the type of heel targeted for protection. Such contouring is probably a necessity of using the spring inserts to hold them in place.

United Kingdom Pat. No. 275,019 presents a protector for the backs of shoes and boots which is held in place, not by a steel spring, but rather by the side cheeks of the protector which tend to close in and grip the shoe or boot. The major drawback of this invention is that it does not entirely protect the heel of the shoe since the heel is exserted from the protector through a heel-shaped orifice.

U.S. Pat. No. 3,217,430 by J. Novick presents two (2) types of heel protectors, one for a man's shoe and one for a woman's high heel. The protectors are closely contoured to the shape of the target heels. It is obvious that the man's protector is not interchangeable with the woman's protector. Furthermore, the high heel is not entirely protected.

This invention presents a universal footwear protector for practically all sizes of heeled footwear including shoes, boots, and high heels. It is a one piece, molded and therefore easily manufactured device which can be modified by the user to fit his or her particular shoe configuration and heel size. Furthermore, this invention does not require the use of any sort of resilient inserts such as the U-shaped springs and the bow springs used in the previously discussed patents.

Other advantages and attributes of this invention will be readily apparent upon a reading of the text hereinafter.

SUMMARY OF THE INVENTION

This invention presents a protector with a shield portion which is a generally U-shaped wall with an open front adapted to follow the general contour of the heel and a suitable portion of backside of the footwear. A first heel binding strap portion projects outwardly from the lateral edges of the shield portion forming a loop at the base of the shield generally in the shape of a heel. The first heel binding strap portion is resilient and when the heel is inserted therein, it embraces the breast of the heel and frictionally holds the protector in place. A heel stop portion at the base of the shield helps to locate the heel in the protector and prevents the shield from riding up the heel. A second heel binding strap portion is a strap which extends across the saddle of the U-shaped shield portion and performs the same function as the first heel binding strap portion for heels too small to be bound by the first strap portion. On the back of the shield portion are defined a pair of parallel horizontal slots which create a tab means. The tab means performs the function of a binding strap for heels with significantly reduced cross section such as spiked and high heels. Preferably the protector is a single molded piece of elastic material which can be modified by its user to conform to the heel size of the target footwear. When in use with high heels, spiked heels and small heels, the first heel binding strap portion can be cut from the shield using common household shears. When using the protector for ordinary men's shoes or boots with larger heels, the second heel binding strap portion can be cut from the shield.

An object of this invention to provide a footwear protector capable of protecting the entire heel and a portion of the backside of the footwear.

It is a further object of this invention to provide a protector of footwear which protects the entire heel and a portion of the backside of the footwear and which is modifiable by the user to adapt the protector the user's particular shoe and heel configuration.

It is another object of this invention to present a universal heel protector for use with practically all sizes of shoes, boots and heels requiring only slight modifications with the use of common household shears.

Other objects of this invention will be readily apparent upon the reading of the text hereinafter.

DESCRIPTION OF THE PREFERRED EMBODIMENT

Figure 1:
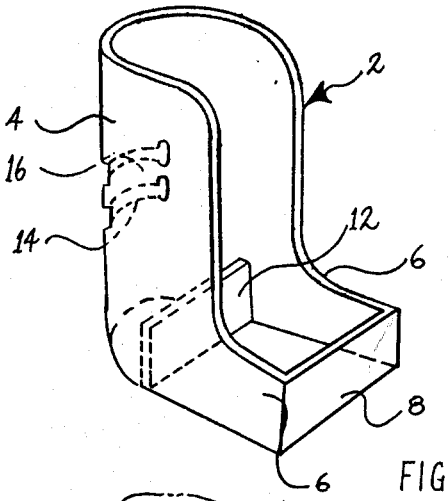
FIG. 1 is a pictorial of the protector.
Figure 2:
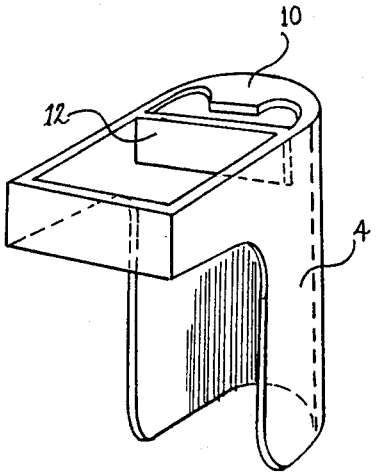
FIG. 2 is a bottom side pictorial of the protector.

Referring to FIGS. 1 through 4, the protector itself is generally designated as 2. The protector 2 has a shield portion 4 which is a generally U-shaped wall with an open front. The shield is adapted to envelope the heel and a suitable portion of the backside of the footwear. Extending outward from the lateral edges of the shield 4 are two (2) side straps 6 which are joined by a cross strap to form a first heel binding strap portion 8. The first heel binding strap portion 8 is preferably resilient and when in place on a heel it frictionally holds the protector in place by embracing the breast of the heel. A heel stop portion 10 is shown as a shoulder of the shield 4 located at the base of the shield and extending inward of the shield. The heel stop portion helps to locate the heel in the protector and prevents the shield from riding up the heel during normal operation of the shoe.

A second heel binding strap portion 12 is a strap which extends across the saddle of the shield 4 and is affixed at both ends to the shield. The second heel binding strap portion 12 performs the same function as the first strap portion except it is positioned to accept smaller heels, that is heels which are too small for the first heel binding strap. The strap portion 12 also serves as a strut when the protector is configured for high heel shoes. The shield 4 defines a pair of parallel horizontal slots 14 which are suitably spaced above the base of the shield. The slots 14 create a tab means 16. The tab means is used to fasten around about high heels or spiked heels serving the same function as the first and second heel binding strap portion.

Figure 3:
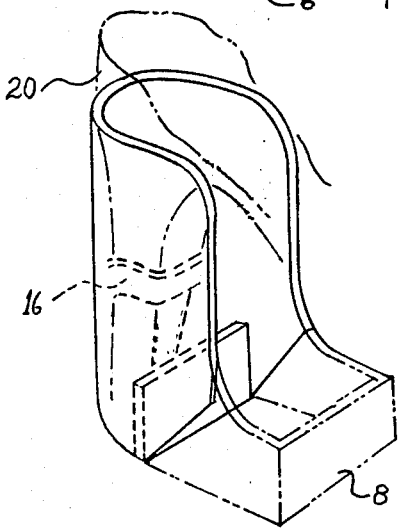
FIG. 3 is a pictorial of the protector as modified for a high heel shoe.
Figure 4:
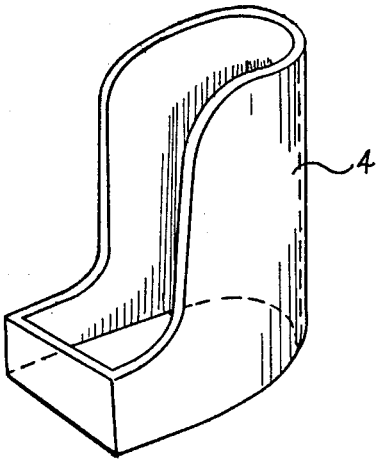
FIG. 4 is a pictorial view of the protector as modified for a normal sized shoe heel or boot heel.

Referring to FIG. 3, a phantom high heel 20 is shown bound by tab means 16. Also illustrated is the fact that in the case of a high heel shoe, the first heel binding strap portion 8 can be removed by common household shears.

Figure 5:
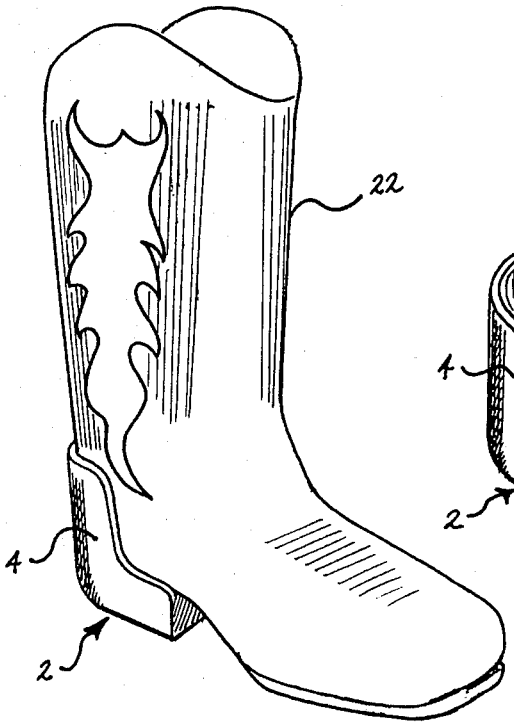
FIG. 5 is a pictorial representation of the protector on a western style boot.
Figure 6:
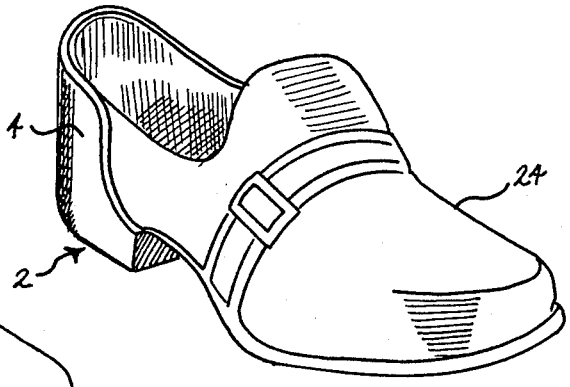
FIG. 6 is a pictorial of the protector on a shoe.
Figure 7:
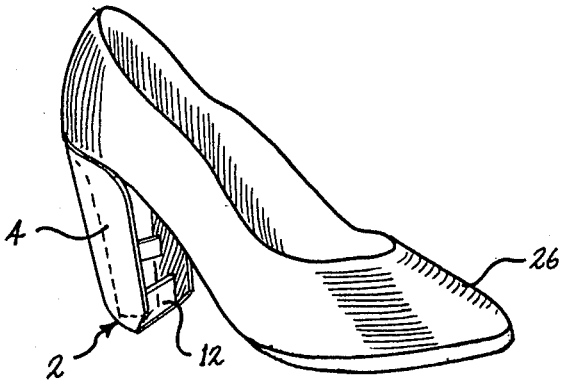
FIG. 7 is a pictorial view of the protector on a high heel shoe.

Referring to FIGS. 5, 6 and 7, the protector is shown on a variety of heeled footwear. Referring to FIG. 7, it can be seen that the first heel binding strap portion has been removed and the protector 2 is bound to the heel by tab means 16. In this case the strap portion 12 acts as a strut.

The protector is preferably made of molded elastic plastic material. The elasticity will permit the shield to bend to conform to a variety of heels and the elasticity of the tab means and the first and second heel binding strap portions permits the protector to be frictionally held in all three (3) configurations.

The foregoing was given for illustrative purposes only and no unnecessary limitations on the appended claim should be taken therefrom.

I claim:

1. A device to protect a heel and a portion of a backside of footwear comprising:

(a) a shield portion which is a wall of generally U-shaped cross-section adapted to envelop the sides and backside of the heel and a suitable portion of the backside of the footwear, (b) a heel stop portion disposed at a base of the shield adapted to prevent the shield from riding up the heel, (c) a first heel binding strap portion affixed to the shield at its base and adapted to resiliently embrace a breast of the heel and thereby frictionally hold the device in place, and (d) a second heel binding strap extending across a saddle of the shield and affixed to the shield at its base and adapted to resiliently embrace a breast of a heel which is too small to be embraced by the first heel binding strap.

2. A device to protect a heel and a portion of a backside of footwear comprising:

(a) a shield portion which is a wall of generally U-shaped cross-section adapted to envelop the sides and backside of the heel and a suitable portion of the backside of the footwear, (b) a heel stop portion disposed at a base of the shield adapted to prevent the shield from riding up the heel, (c) a first heel binding strap portion affixed to the shield at its base and adapted to resiliently embrace a breast of the heel and thereby frictionally hold the device in place, and (d) a tab means suitably spaced above the base of the shield and created by a pair of horizontal slots defined by the back of the shield, the tab means being adapted to resiliently embrace a breast of a heel too small to be embraced by the first heel binding straps, such as a high heel.

3. The device of claim 1 further comprising a tab means suitably spaced above the base of the shield and created by a pair of horizontal slots defined by the back of the shield, a tab means being adapted to resiliently embrace a breast of a heel too small to be embraced by the first and second heel binding strap such a high heel.

4. The device of claim 1, 2 or 3 wherein the device is integrally constructed.

5. The device of claim 4 wherein the device is constructed of cutable material such that the first heel binding strap and a suitable portion of the shield may be cut from the device by use of a commonly available cutting means such as common household shears.

* * * * *